US011089844B2

(12) United States Patent
Vaccari

(10) Patent No.: US 11,089,844 B2
(45) Date of Patent: Aug. 17, 2021

(54) BUCKLE-TYPE CLOSING DEVICE

(71) Applicant: FERPLAST S.P.A., Castelgomberto (IT)

(72) Inventor: Nicola Vaccari, Castelgomberto (IT)

(73) Assignee: FERPLAST S.P.A., Castelgomberto (IT)

( * ) Notice: Subject to any disclaimer, the term of this patent is extended or adjusted under 35 U.S.C. 154(b) by 0 days.

(21) Appl. No.: 16/622,178

(22) PCT Filed: Jun. 12, 2018

(86) PCT No.: PCT/IB2018/054221

§ 371 (c)(1),
(2) Date: Dec. 12, 2019

(87) PCT Pub. No.: WO2018/229637

PCT Pub. Date: Dec. 20, 2018

(65) Prior Publication Data

US 2020/0121032 A1 Apr. 23, 2020

(30) Foreign Application Priority Data

Jun. 16, 2017 (IT) ..... 102017000067329

(51) Int. Cl.
*A44B 11/26* (2006.01)
*A44B 11/25* (2006.01)
(Continued)

(52) U.S. Cl.
CPC ..... *A44B 11/266* (2013.01); *A44B 11/2592* (2013.01); *A44B 11/006* (2013.01);
(Continued)

(58) Field of Classification Search
CPC . A44B 11/266; A44B 11/2592; A44B 11/006; A44C 5/2071; A45C 13/1069;
(Continued)

(56) References Cited

U.S. PATENT DOCUMENTS 2,475,226 A * 7/1949 Ellis ..... A43B 1/0054 24/303
5,323,516 A 6/1994 Hartmann
(Continued)

FOREIGN PATENT DOCUMENTS

EP 0590207 A1 4/1994
WO 9531120 A1 11/1995

OTHER PUBLICATIONS

International Search Report for PCT/IB2018/054221, dated Sep. 20, 2018, 5 pages.

*Primary Examiner* — Robert Sandy
(74) *Attorney, Agent, or Firm* — Ference & Associates LLC

(57) ABSTRACT

A buckle-type closing device including a first component and a second component that are associable with one another in a releasable manner, the first component including a chamber in which a magnet is housed and a support element, and the second component including a ferromagnetic locking element that is adapted to interact, in operation, with the magnet, the locking element being movable between a first released position and a second locking position in which the locking element is attracted by the magnet against the support element.

6 Claims, 7 Drawing Sheets

(51) Int. Cl.
*A44B 11/00* (2006.01)
*A44C 5/20* (2006.01)
*A45C 13/10* (2006.01)

(52) U.S. Cl.
CPC ..... *A44C 5/2071* (2013.01); *A44D 2203/00* (2013.01); *A45C 13/1069* (2013.01)

(58) Field of Classification Search
CPC ..... A44D 2203/00; Y10T 24/45639; Y10T 24/45644; Y10T 24/45675; Y10T 24/45702; Y10T 24/32
See application file for complete search history.

(56) References Cited

U.S. PATENT DOCUMENTS 5,515,581 A * 5/1996 Kaufmann ..... A45C 13/1069 24/303
8,914,951 B2 * 12/2014 Gaudillere ..... A44B 11/266 24/303

* cited by examiner

BUCKLE-TYPE CLOSING DEVICE

FIELD OF APPLICATION

The present invention relates to a closing device for belts, retaining bands or other similar fastening or connecting means.

In particular, the closing device according to the invention is represented by a buckle intended for use, even if not exclusively, in advantageous combination with leads or collars or other harnesses for pets, typically represented by dogs.

With respect to known solutions, the closing device according to the invention offers simpler and more rapid and at the same time safer possibilities of use, i.e., in general, improved coupling and uncoupling methods.

The present invention is advantageously applied in the sector of accessories for pets and in particular, in the case of retaining means for dogs or other similar pets, but can also be used in other sectors such as for example the sporting sector, the sailing sector or in the mountaineering sector or also in the packaging sector or in clothing or accessories or in all those applications that involve the use of bands or tie rods or other items.

PRIOR ART

It is known that belts, straps, bands, ropes, strings or cables or other similar retaining means are commonly used on numerous leather goods, footwear, clothing and other accessories in general like bags, briefcases, suitcases, rucksacks or harnesses and leads for pets.

Generally, the essential components that make up a belt or a lead consist of a band of the rope type but more preferably of the web type, at least one of which ends comprises a buckle that in the case of a belt is intended to couple with the opposite end, whereas in the case of a lead it enables a collar or other harnessing elements of the animal to be coupled.

Typically, one buckle consists of a frame that can have different shapes, such as circular or rectangular or mixed shapes and comprises a buckle tongue that constitutes the locking element of the opposite end of the appropriately bored belt, whereas more recently plastic buckles with snap closing or rapid coupling have become popular that generally consist of two elements, a male element and a female element, that snap-close reciprocally, where the male element is fixed to the end of a first elongated element and the female element is fixed to the end of a second elongated element.

Generally, the male element of this buckle comprises a pair of elastic tongues, each of which is provided with a tooth placed at the end, in which each of the teeth is arranged opposite the other. In order to connect the two ends to be joined, the elastic tongues of the male part of the buckle penetrate suitable seats in the female part, causing locking thereof in the form of elastic fitting. To open the buckle, the elastic tongues are pressed against one another so as to unlock the mechanism to enable the two parts to be detached.

These are amongst the most widely used solutions but, in use, problems of impracticality of use and possible breakage of the continuously stressed elastic parts and difficulties of reciprocal joining have been encountered.

Further closing devices known in the prior art, made to overcome the problems of snap buckles, are for example indicated in EP2833754, in which it is disclosed that for the detachable connection of two parts a fitting locking element is used that is made of two parts, each of which is fixed to each end of the elements to be connected, said two parts comprising coupling protrusions made in such a manner that the first coupling projection can be taken to couple with the second coupling projection in the coupling direction, so that in the normal position the positive coupling of the first coupling projection with the second coupling projection is locked against the coupling direction.

In this case, between the first closing part and the second closing part a magnetic mechanism acts that is formed to support the coupling of the first closing part with the second closing part by providing a magnetic attraction force that avoids the detachment of the joined parts.

This solution provides for two magnets, i.e. one installed on the male part and the other on the female part of the buckle, but maintaining the closure between the two elements of the buckle is purely mechanical due to the contrast between the first and the second projection, whereas the magnets enable the two elements to be attracted.

In other words the magnets do not perform a resistance function, but only an attracting function to invite the two parts that have to join one another, so it is true that without the magnets the system would function in the same manner whereas the core of this solution relates to the coupling between two projections that remain locked along the opening axis.

In this case, the buckle is constructionally complex and does not offer sufficient characteristics of resistance to mechanical stress and simplicity of use.

Similarly, also the solution proposed in EP3039983 provides a closing device between two parts to be connected, comprising a first closing component with a first stiff closing projection and a second closing component that is attachable to the first closing component and in a closed position is held on the first closing component.

In this case, the second closing component comprises a second stiff closing projection in which the second closing projection can be engaged to the first closing projection in an engagement direction and in the closed position engages the first closing projection in a positive closing manner.

According to this solution, the first closing component comprises a first magnetic component and the second closing component comprises a second magnetic component, where the first magnetic component and the second magnetic component are constituted to attract one another magnetically when the second closure member adheres to the first closure member to close the closure device.

Also in this case, the magnets do not perform a holding function, but only an attracting function to lead the two parts that have to join one another, so it is true that without the magnets the system would function in the same manner whereas the core of this solution relates to the coupling between the components that remain locked along the opening axis.

Lastly, according to US20150337879 a closing device comprises a first closing part and a second closing part that can be joined to one another, in this case being completely mechanical means, i.e. means that is not associated with mechanical means as the closing means is of the elastic type that is slidable along the engagement direction.

Document U.S. Pat. No. 5,323,516 discloses a closing device according to the preamble of claim 1.

DESCRIPTION OF THE INVENTION

The present invention proposes providing a buckle-type closing device for belts, retaining bands or other similar buckling or connecting means provided with a coupling between two projections kept in place owing to the presence of a magnetic element that is the element that is able to maintain the two parts in a closed position, thus creating a condition that is able to eliminate or at least reduce the drawbacks highlighted above.

The invention proposes in particular providing a closing device that is easy to make and effective to use in all situations in which a coupling has to be made between two ends to be joined, for example between components of a lead or other applications also in other sectors like for example sport or leisure, in the sailing sector or in the mountaineering sector or also in the sector of packaging or also clothing or accessories.

This is obtained through a buckle-type closing device, whose characteristics are described in the main claim.

The dependent claims of the present solution delineate advantageous embodiments of the invention.

The main advantages of this solution relate to the fact that the buckle-type closing device consists of two parts that co-penetrate and are retained in the closing step by a lever component that is retained in the closed position by a magnet with respect to which the lever component can be released to move to the open position.

A further advantage offered by the closing device according to the invention is due to the fact that the closing and retaining means of the two mutually coupling parts ensure optimum resistance to even sudden tension, and are simple to use because they are snap-fitting and self-centering in the closing steps and are as rapid and simple to release during the opening steps.

ILLUSTRATION OF THE DRAWINGS

Further characteristics and advantages of the invention will become apparent from reading the following description of an embodiment of the invention provided by way of non-limiting example with the aid of the figures illustrated in the appended tables of drawings, in which.

DESCRIPTION OF AN EMBODIMENT OF THE INVENTION

Figure 1:
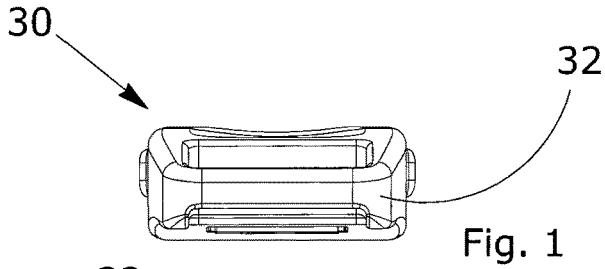
FIGS. 1 to 6 show schematic views taken from different angles showing the buckle-type closing device according to the invention in joined mode.
Figure 2:
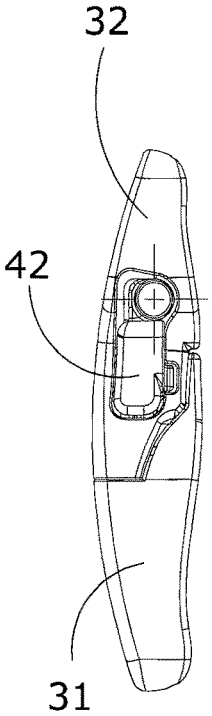
Figure 3:
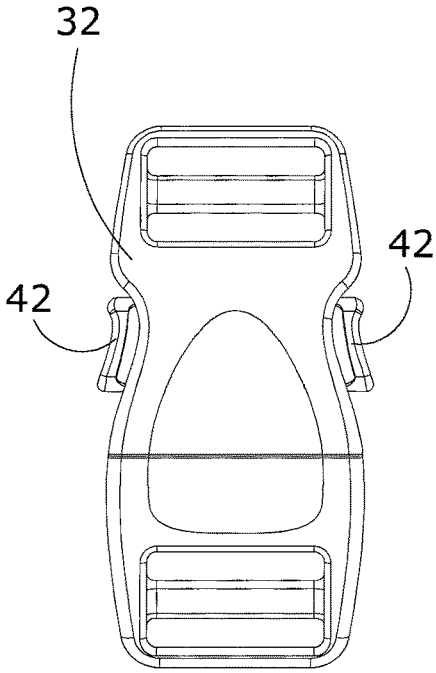
Figure 4:
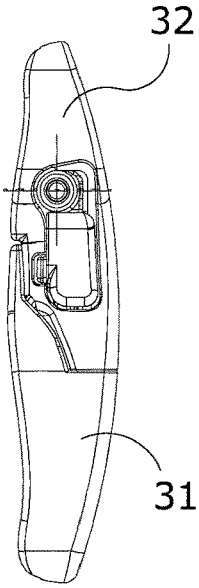
Figure 5:
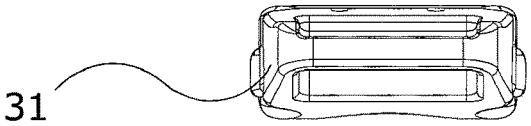
Figure 6:
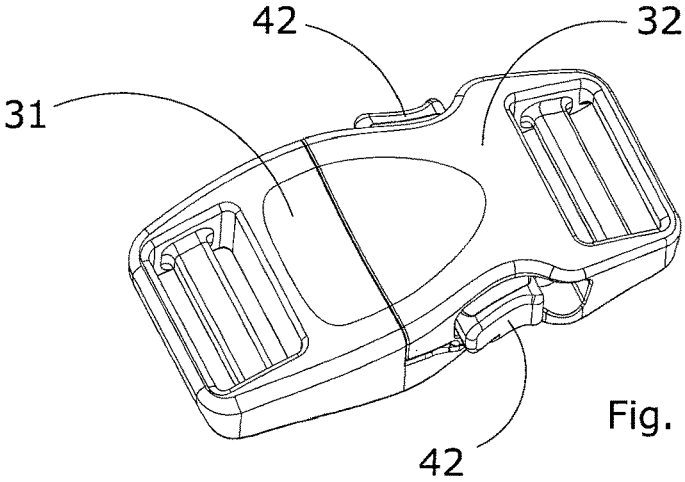
Figure 7:
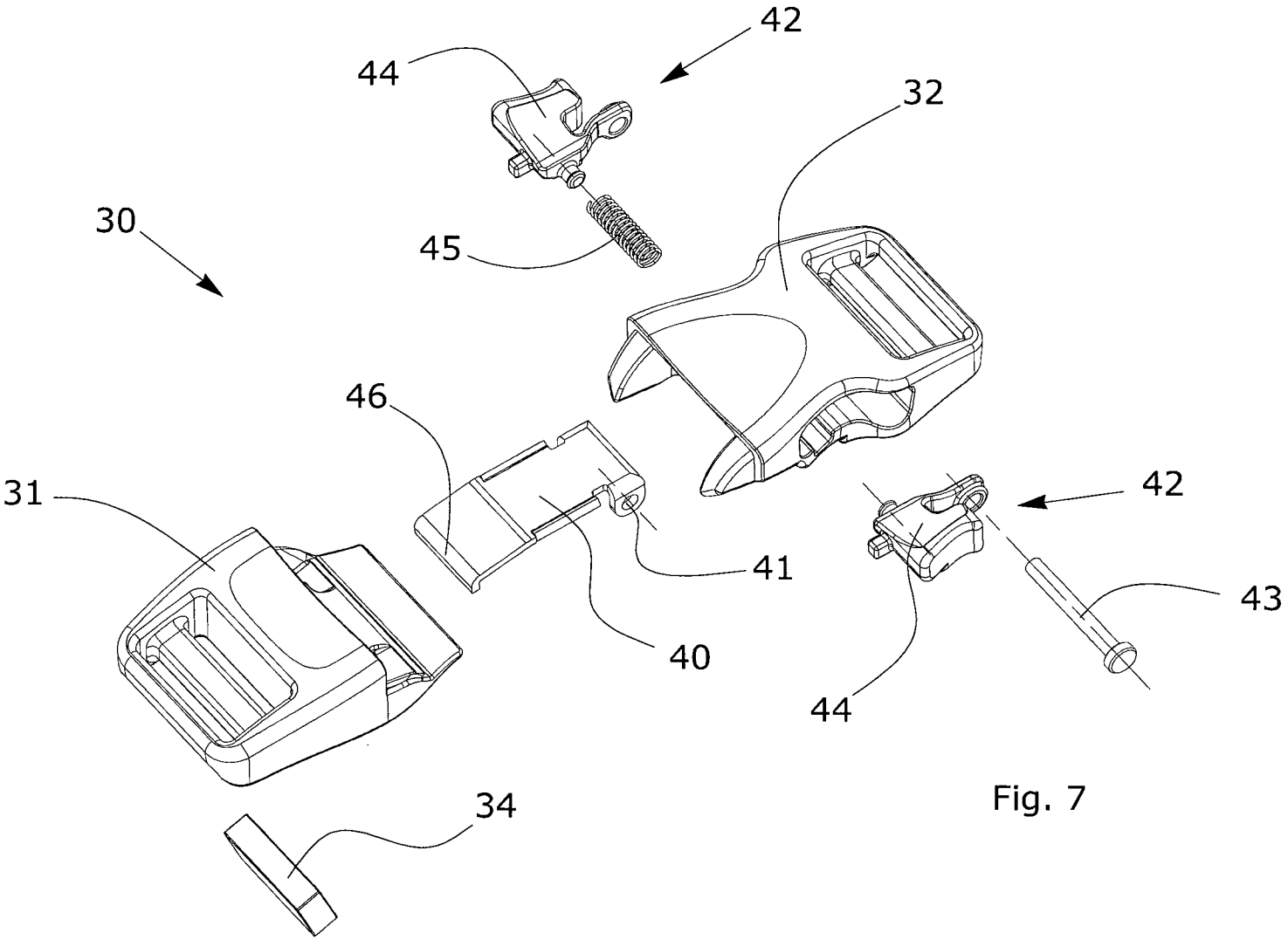
FIG. 7 illustrates a schematic view highlighting the buckle-type closing device according to the invention in an exploded view.
Figure 8:
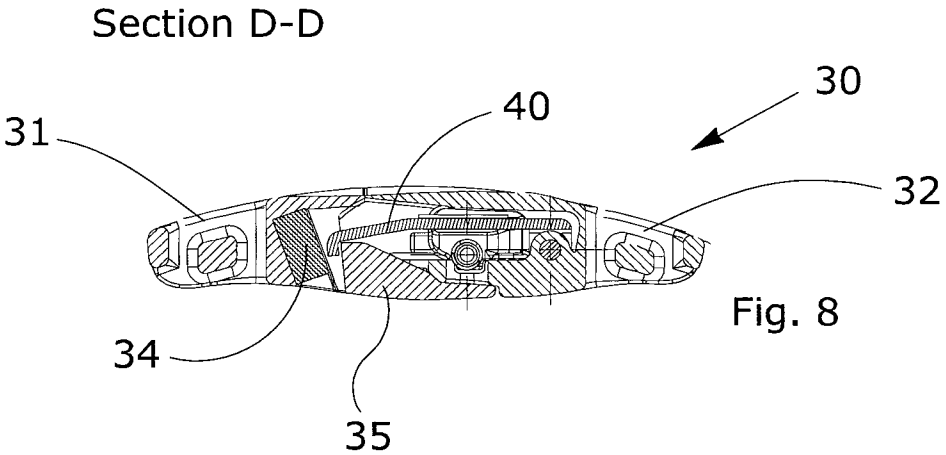
FIGS. 8 to 10 show schematic views of the buckle-type closing device according to the invention, arranged in coupled mode and in section according to lines D-D and E-E of FIG. 9.
Figure 10:
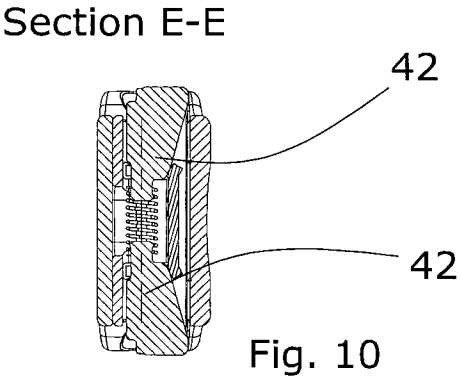
Figure 9:
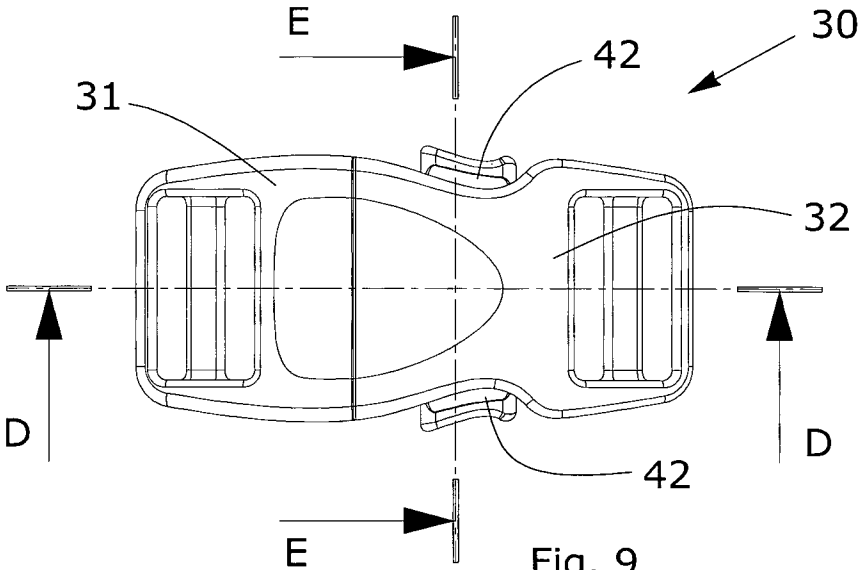
Figure 11:
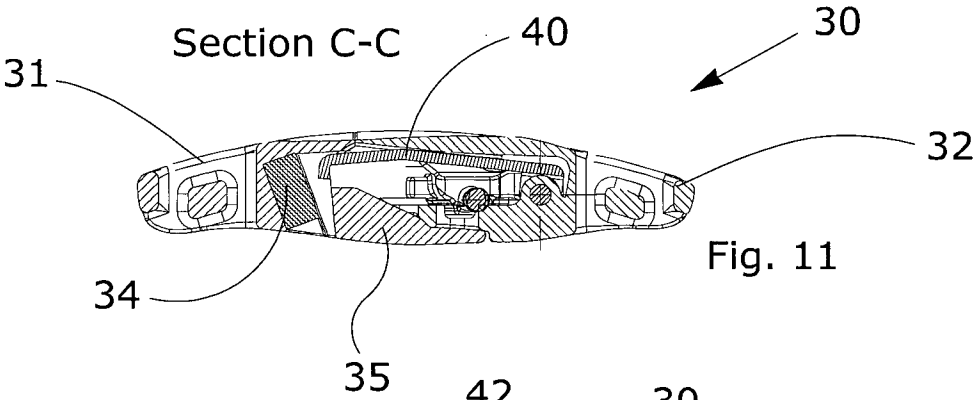
FIGS. 11 to 13 show schematic views of the buckle-type closing device according to the invention, arranged during the uncoupling step and in section according to lines C-C and D-D of FIG. 12.
Figure 12:
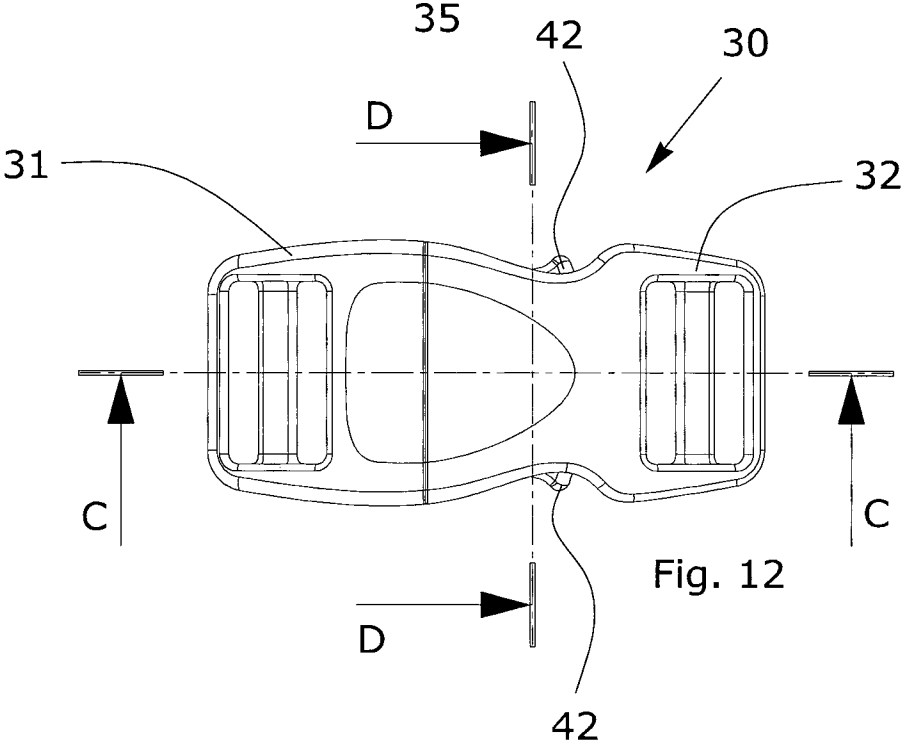
Figure 13:
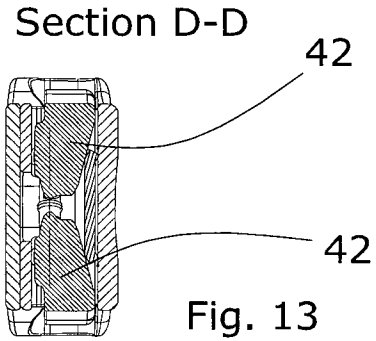
Figure 14:
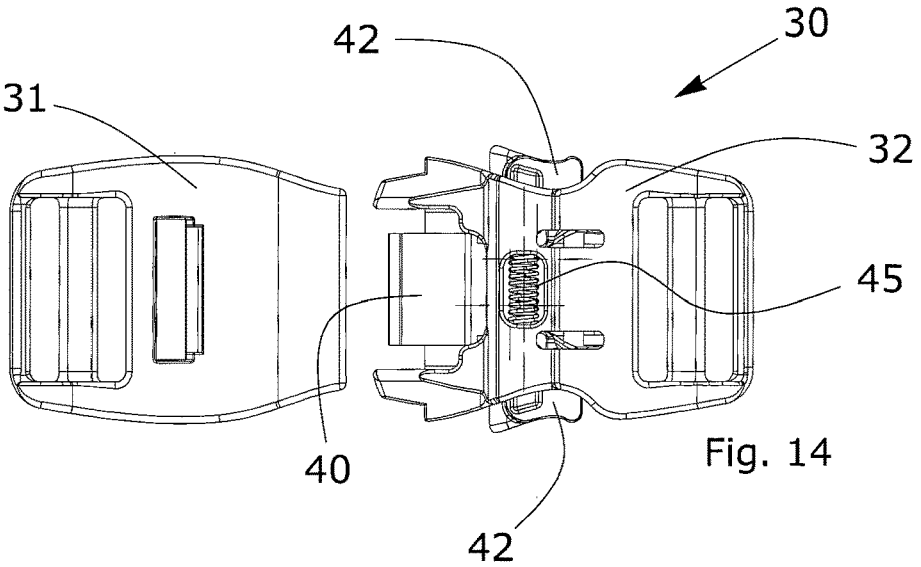
FIGS. 14 to 17 illustrate schematic views of the buckle-type closing device according to the invention, arranged during the completely uncoupled step, partially transparent and in section according to lines B-D of FIG. 16.
Figure 15:
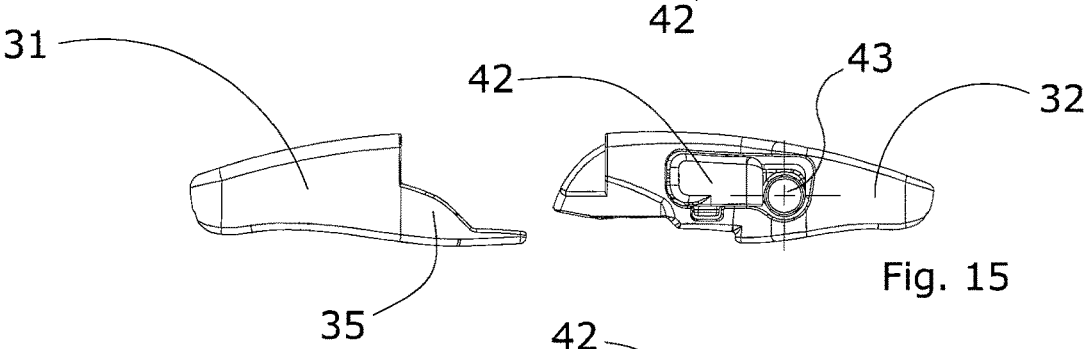
Figure 16:
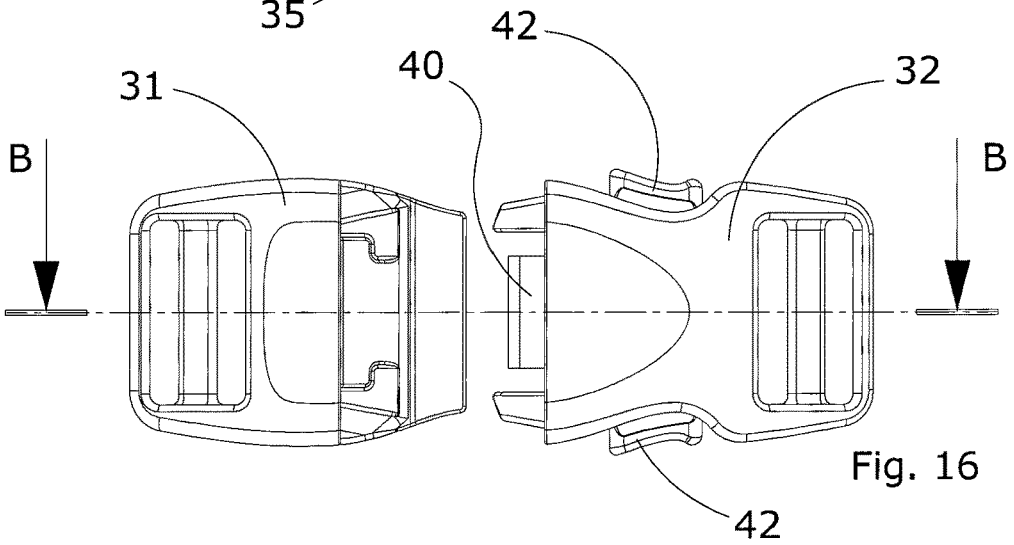
Figure 17:
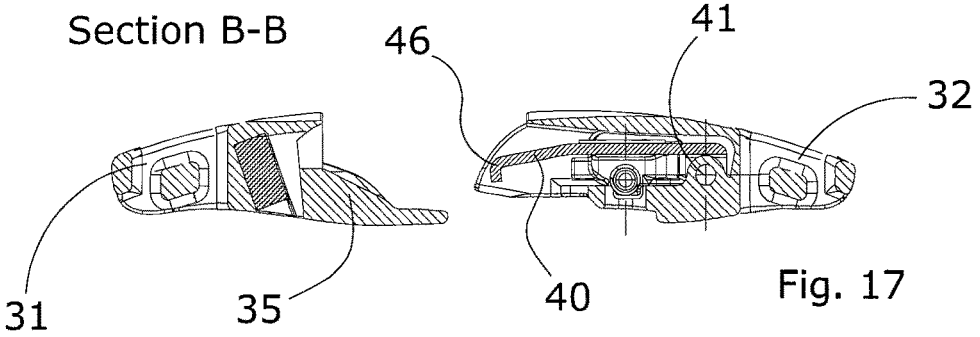

With reference to the attached figures, and initially in particular to FIG. 7, number 30 generally indicates a buckle-type closing device according to the invention, that consists of a first component 31 associable with the first of the two ends of a strap to be joined and of a second component 32 that is associable with the second of the two ends of the strap or of another strap.

In the case of a collar or a harness for dogs, which represents the typical use of the invention without thereby excluding other possible uses thereof, the first component 31 is fixed to an end of the clamp of a collar, whereas the second component 32 is fixed to the other end, so that by joining the two ends of the collar and winding it around the neck of the pet, coupling occurs rapidly and securely.

According to the invention, inside the first component 31 of the buckle 30 a chamber 33 is obtained (FIG. 20) in which a magnet 34 is housed.

Figure 18:
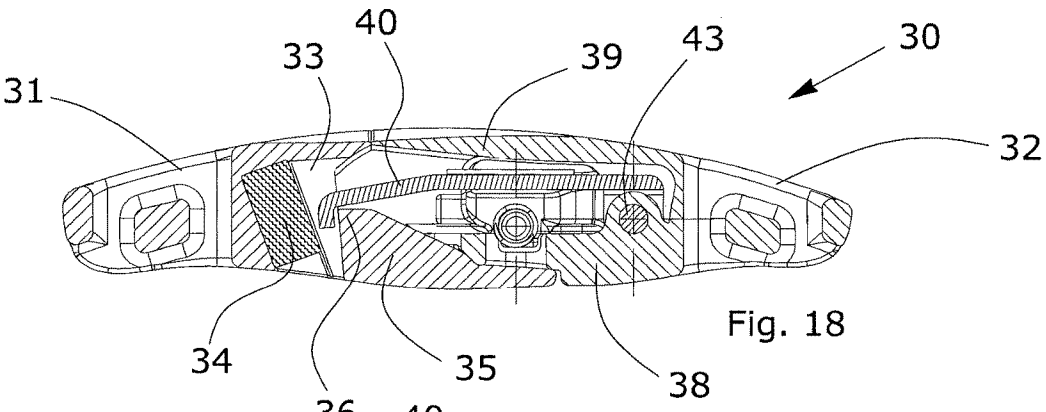
FIGS. 18 to 20 are detailed schematic views and in a section that is taken along the longitudinal centreline of a buckle according to the invention respectively in a closed position, in an uncoupling and completely uncoupled step.
Figure 19:
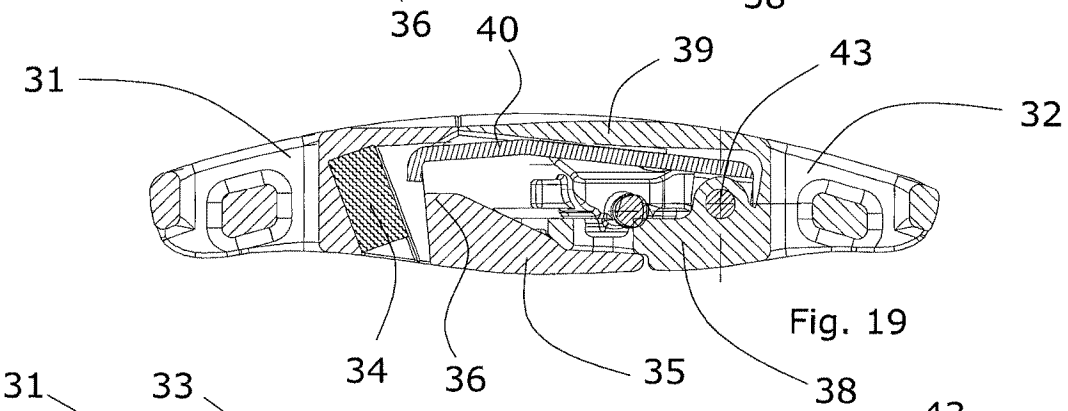
Figure 20:
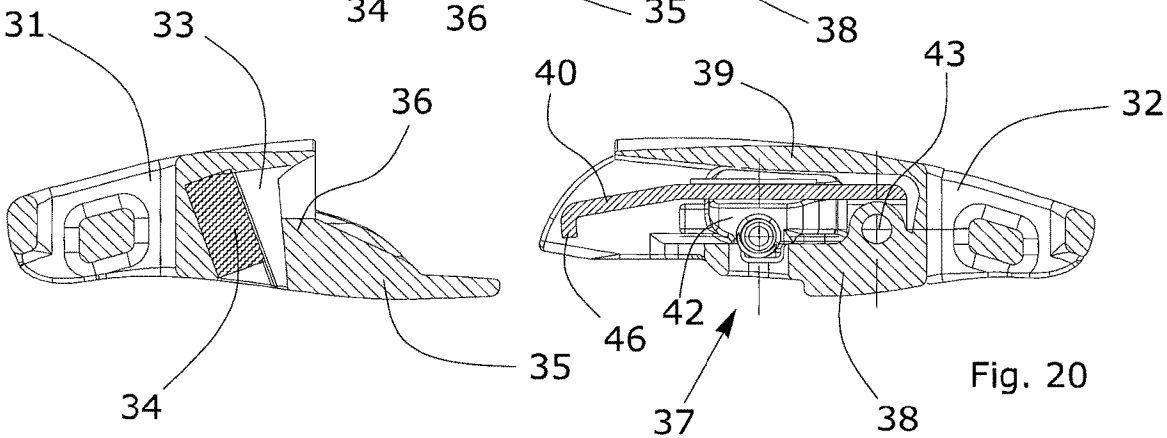

According to the embodiment shown in FIGS. 18 to 20 it is pointed out that the chamber 33 has an opening facing the end of the second component 32 of the buckle, which is engaged on the first component 31 in the closing steps.

Further, the first component 30 comprises a support element of the projecting support 35 that forms a corner that constitutes the element on which the locking device will engage, as will be seen below.

The second component 32, associable with the second of the two ends of the second component 32 of the same or of another strap, has a joining front thereof that is shaped in a manner that is complementary to the first component 31, so as to be able to associate perfectly in a fitting manner therewith.

In particular, as shown in FIG. 20, the second component 32 comprises a hollow zone 37 delimited by a lower delimiting element 38 and by an upper wall 39.

Figure 21:
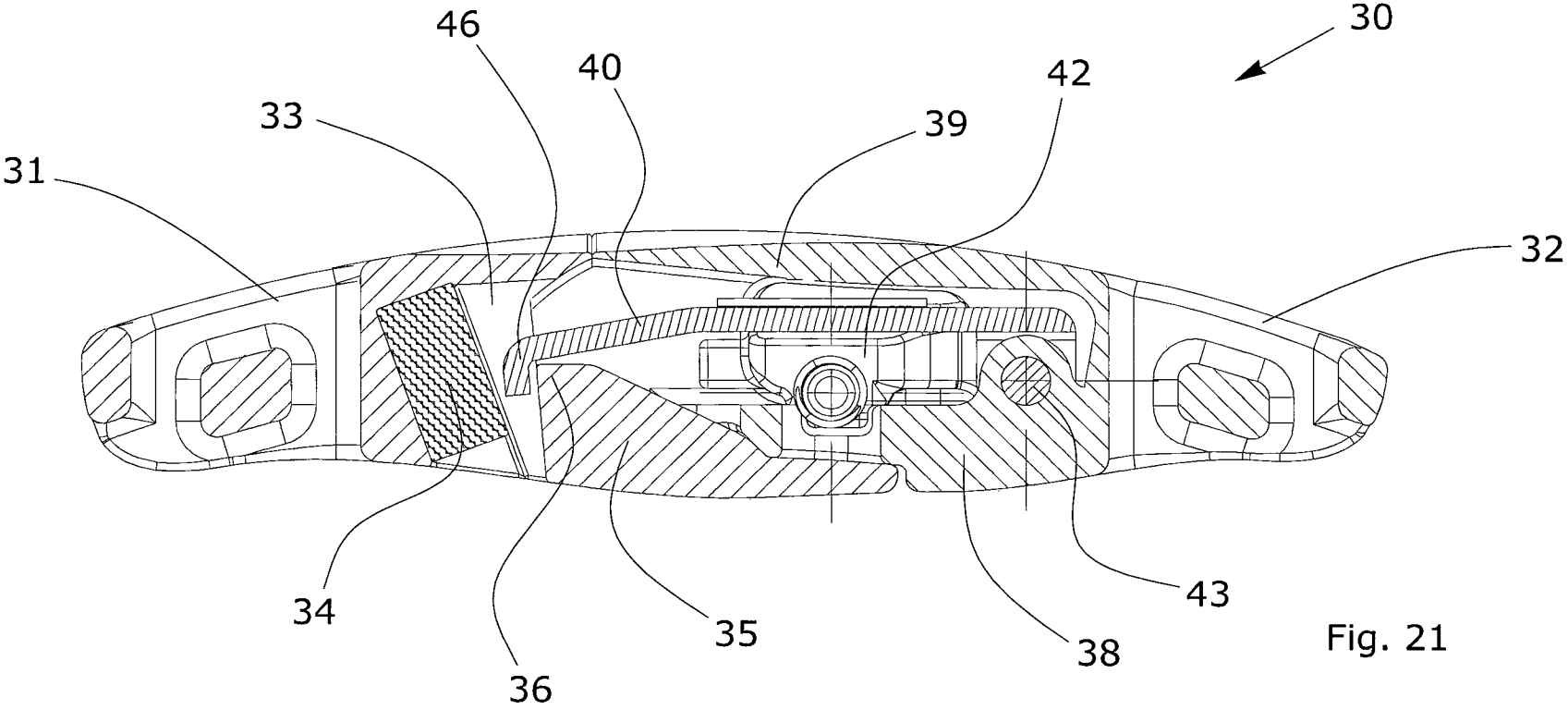
FIG. 21 shows a detailed section view of the buckle.

In the embodiment shown in FIGS. 7 and 21, in said hollow zone a locking element 40 is housed, comprising a lever made of ferromagnetic material, provided with drilled projections 41 and is movable in a direction that is rotational with respect to a pin 43, and a pair of thrust components 42 that are reciprocally opposite in a specular manner with respect to the longitudinal centreline of the buckle and are positioned on the same pin 43 on which the lever 40 is rotatably fixed.

The release components 42 are movable elastically towards or away from one another to move from a far position to a near position with respect to the centreline and with respect to the lever 40 that they intercept.

According to the embodiment illustrated in FIG. 7 the pair of release components 42 has inclined planes 44 that are arranged specularly to one another, i.e. converging towards the centre, forming an obtuse angle, and are placed in contrast by a spring 4 that maintains the planes 44 spaced reciprocally apart with respect to the longitudinal centreline of the buckle.

Said locking lever 40 that is movable in a rotatable direction with respect to said pin 43, has an arched conformation and ends with a folded end 46 that forms a coupling element adapted to be associated with the corner 36 of the projecting support 35 which it grips, being attracted, in the closed position of the buckle, by the magnet 34.

According to this embodiment, the approach of the thrust components 42 causes lifting of the lever 40 because the inclined surfaces 44 of the release components 42 intercept the lever in the step in which the inclined surfaces 44 approach, pushing to make the lever rise, with consequent disengagement from the corner 36 and the consequent opening of the buckle, overcoming the attraction of the magnet 34.

It should be noted that in order to ensure the opening of the buckle, the two thrust components 42 both have to be pressed simultaneously. In fact, a minimum clearance between the pin 43 and the holes 41 of the lever 40 is provided, so that, if just one of the two elements 42 is pressed, there is no complete rotation of the lever 40, which on the other hand tilts to one side, thus remaining constrained to the corner 36 and preventing the detachment between the two half parts 31 and 32 of the buckle.

In other words, said rotatable lever 40 is equipped with an anti-unlocking safety system according to which said pin 43 is inserted into said holes 41 of the lever with a clearance that prevents the opening of the lever in the event of acting on only one of the two release components 42, since the two components themselves are released from one another, allowing the opening of the lever only through simultaneous action on both.

This characteristic represents a further safety element because it prevents unwanted opening of the buckle if just one of the two buttons is pressed.

According to a further embodiment, said locking element 40, comprising a lever made of ferromagnetic material, is equipped with an association means of the type with a hole intercepted by at least one respective projection of said support 35.

According to further embodiments, said locking element 40 comprising a lever made of ferromagnetic material is equipped with suitable association means associating with said support 35 of the projection type intercepted by at least one respective hole of said support 35.

According to further embodiments, technical solutions are also provided that replace the thrust components 42 and which are adapted to overcome the force of attraction between lever 40 and magnet 34.

In this case for example, a selector is used that is raised or lowered, or a lever is used that is provided with a cam profile that by rotating acts on the lever, to raise the lever or also something else.

The steps of uncoupling and coupling the buckle according to the invention will now be disclosed from the operational point of view.

Starting from the closed position illustrated in FIGS. 18 and 21, in order to open the buckle, it is thus necessary to act with two fingers on the two release components 42 to move the two release components 42 towards one another. The two specularly inclined sectors of the thrust components 42 tend in this manner to approach one another and be arranged below the lever 40 with which they interfere, and they impress a rotation on the lever that enables it to be lifted upwards, being released from the corner 36 whilst the attraction of the magnet 34 is overcome.

In this manner, the two components of the buckle can be released to move to the position shown in FIG. 20.

On the other hand, in order to close the buckle, it is sufficient to bring the two components 31 and 32 towards one another that co-penetrate in a fitting manner until the folded end 46 of the lever 40 of the second component 32 covers the corner 36 of the support 35 that is part of the first component of the buckle, because attracted by the magnet 34.

The invention has been described above with reference to a preferred embodiment thereof. However it is clear that the invention is susceptible to numerous variants which fall within the scope thereof, and which are technically equivalent.

The invention claimed is:

1. A buckle-type closing device placed between two parts to be connected to one another, comprising a first component and a second component that can releasably be associated with the first component, wherein the first component comprises a chamber in which a magnet is housed and a support element, and wherein the second component comprises a ferromagnetic locking element adapted to interact, in operation, with the magnet, whereby the locking element is movable between a first released position and a second locked position in which it is attracted by the magnet against the support element, the locking element comprising a lever that is rotatable about a pin, the lever having a folded end forming a coupling element that can be connected to the support element, whereby the second component comprises a mechanical element adapted to act on the locking element to overcome the magnetic force of attraction of the magnet and return the locking element into the released position, wherein the mechanical element comprises a pair of release members which are elastically opposing one another in a specular way with respect to a longitudinal centerline of the closing device, each of the pair of release members comprising a respective inclined surface adapted to release the locking element by wedging itself between the rotatable lever and a fixed part, and distancing the rotatable lever with respect to the magnet and thus releasing the locking element from the support element.

2. The device of claim 1, wherein each release component comprises a selector that is raised or lowered to bring the locking element from a released position to a constrained position with respect to the first component.

3. The device of claim 1, wherein the mechanical element comprises an unlocking element comprising a cam profile which, by turning, acts on the locking element, placing it in a distanced condition with respect to the magnet and in a released condition from the support element.

4. The device of claim 1, wherein said locking element comprises with a hole receiving at least one respective projection element of the support element.

5. The device of claim 1, wherein the locking element comprises an anti-unlocking safety system in which the pin is inserted into a respective pair of holes provided in a body of said rotatable lever with a clearance preventing the rotatable lever to be opened in the event of acting on only one of the first and second release components, the two release components themselves being released from one another and allowing the rotatable lever to be released from the support element only through simultaneous action on both release components.

6. The device of claim 1, wherein the locking element comprises a projection element to be inserted into at least one respective hole of the support element.

* * * * *